United States Patent [19]

Wallace et al.

[11] 4,243,330

[45] Jan. 6, 1981

[54] DOT PRINTER ADJUSTABLE ENDLESS LOOP RIBBON CARTRIDGE TRANSPORT APPARATUS

[75] Inventors: Harry L. Wallace, Livonia; Anthony Horak, Detroit; Frederick G. Krebs, Rochester; Louis R. Brown, Livonia, all of Mich.

[73] Assignee: Burroughs Corporation, Detroit, Mich.

[21] Appl. No.: 3,496

[22] Filed: Jan. 15, 1979

[51] Int. Cl.[3] ..... B41J 33/10

[52] U.S. Cl. ..... 400/194; 400/74; 400/124; 400/601; 400/636; 400/642

[58] Field of Search ..... 400/194, 195, 196, 196.1, 400/205, 205.1, 208, 235.1, 248; 209/552

[56] References Cited

U.S. PATENT DOCUMENTS

| | | | |
|---|---|---|---|
| 833,227 | 10/1906 | Kunath | 400/194 |
| 1,576,997 | 3/1926 | Renna | 400/205 |
| 1,942,722 | 1/1934 | Mosfelt et al. | 400/235.1 X |
| 1,958,764 | 5/1934 | Mosfelt et al. | 400/194 |
| 2,102,693 | 12/1937 | Garbell | 400/194 X |
| 2,103,734 | 12/1937 | Schmidt | 400/194 |
| 2,508,780 | 5/1950 | Von Duyke | 400/194 |
| 2,755,905 | 7/1956 | Segui | 400/196 |
| 3,621,968 | 11/1971 | Kondur | 400/196 X |
| 3,643,777 | 2/1972 | Anderson et al. | 400/208 |
| 3,643,778 | 2/1972 | Anderson | 400/208 |
| 3,643,779 | 2/1972 | Anderson et al. | 400/196 |
| 3,777,871 | 12/1973 | Zeamer | 400/208 |
| 3,799,315 | 3/1974 | Stewart | 400/208 |
| 3,814,231 | 6/1974 | Cappotto | 400/208 |
| 3,830,351 | 8/1974 | Cappotto | 400/208 |
| 4,155,842 | 5/1979 | Wallace et al. | 209/552 |
| 4,160,605 | 7/1979 | Neubaum | 400/208 |

*Primary Examiner*—Ernest T. Wright, Jr.

*Attorney, Agent, or Firm*—Kenneth J. Cooper; Charles E. Quarton; Kevin R. Peterson

[57] ABSTRACT

Demountable, replaceable, printer ribbon cartridge transport apparatus comprising an elongated, flat, rigid, support member provided with oppositely disposed parallel recessed areas co-extensive with the longer dimension thereof and having means intermediate the ends for adjusting the length of the member and thereafter retaining the adjusted length. An endless inked ribbon is disposed within the recessed areas with each opposite end of the ribbon looped around the end of the support member and back upon itself so as to be moveable lengthwise in opposite directions along the long dimension of the support member. Demountable end caps are secured to each opposite end of the support member to protect the ribbon as it reverses direction about the end of the support and to enable the support member to be cammed into and out of engagement with ribbon drive means. Drive means is engageable with the ribbon effective to move one of the parallel lengths of the ribbon longitudinally along one recessed area so that the ribbon travels around the end of the support member and back to the opposite end in a continuous unending loop to present a fresh area of ribbon to a printing mechanism for printing therefrom until the ink is exhausted or the ribbon is too worn to print.

3 Claims, 10 Drawing Figures

DOT PRINTER ADJUSTABLE ENDLESS LOOP RIBBON CARTRIDGE TRANSPORT APPARATUS

BACKGROUND OF THE INVENTION

The present invention relates to printing apparatus and to printing apparatus for use with item/document sorter reader devices. More specifically, the present invention has to do with printing apparatus for indicating an error in data printed on items such as bank checks or similar documents which are magnetically or optically encoded and wherein the coded data is incorrectly disposed on the item for one reason or another. Still more specifically, the invention has to do with an inked ribbon transport mechanism for such printing apparatus and to a novel, demountable, disposable, endless ribbon transport error indicating device for use in item/sorter printing apparatus.

DESCRIPTION OF THE PRIOR ART

In the area of data processing involving the handling of paper items such as bank checks and similar documents which carry printed data in the form of optical or magnetic characters the magnetic or optical character is sometimes misencoded or incorrectly encoded so that one or more digits are either misplaced or incorrectly printed or the character, symbol etc., is broken or incomplete. It is therefore necessary or required to indicate in some fashion that an error has been detected and to effect measures to correct such deficiencies. In the past, printers have been incorporated within the sorter-reader device utilizing endless ribbons or inking rolls and wherein some indication has been printed on the face of the document or item signifying to the operator that the particular data i.e., numeral, letter or symbol is erroneous. In the past, this has been accomplished by means of a so-called dot printer. However, it has always been a problem not only to sychronize the printing of the dot printer with the passage of the item but to assure that the printed dot will be sufficiently clear so as to enable the operator to take whatever measures or steps are required to make the correction. In the past, the printing mechanisms have employed all manner of inking devices, none of which have proved totally satisfactory and each one of which is limited by problems having to do with dirt and/or replacement or service.

1. U.S. Pat. No. 3,643,777 issued to Carl P. Anderson et al., describes:

A cartridge for housing a supply of ribbon for typewriters or like machines. The cartridge includes an arm extending therefrom to guide the ribbon from the cartridge to the typewriter print point and to reverse the direction of the ribbon for guiding the ribbon back to the cartridge which is supported on a machine rigid frame on one side of the print point. The arm being capable of carrying the ribbon from a point adjacent the print point to the print point as a ribbon vibrator.

2. U.S. Pat. No. 3,643,778 issued to Carl P. Anderson describes:

A typewriter support for guiding a ribbon cartridge to and retaining the cartridge in a rest position. The support includes a U-shaped member which is positioned near the machine side frame, a spring urged detent for retaining the cartridge after it is inserted to a predetermined depth within the guide support and a biasing means for ejecting the cartridge from the support upon manual release of the detent means.

3. U.S. Pat. No. 3,643,779 issued to Carl P. Anderson, et al., describes:

A ribbon mechanism for cartridge supported ribbons includes a gear train which is clutch operated in response to typing actuations and which provides incremental rotation to two independent cartridge-type ribbon driving means for feeding a ribbon past the machine print point. The two independent driving means are coaxially mounted and are driven in opposite direction thus accomplishing both a feed means and a takeup means for either a cartridge having an endless ribbon system supported therein or a cartridge having a two spool ribbon system support therein.

4. U.S. Pat. No. 3,777,871 issued to Aaron C. Zeamer describes:

A ribbon guide or carrier arm for a typewriter ribbon cartridge is disclosed. The carrier arm which is pivotally connectable to the cartridge housing to laterally extend therefrom, has a pair of channels formed therein for guiding a ribbon from the housing to a print point and back to the housing. An aperture is provided adjacent the end of the arm for exposing a portion of the ribbon to the print point. The end of the arm is V-shaped to effect a reversal in the direction of movement of the ribbon. A step having channel means therein for the ribbon is provided at the opening to the V-shaped section. A transparent plastic sheet is secured over the channels in the carrier arm guiding the ribbon and a hollow V-shaped cap is secured over the end of the carrier arm thus shielding most of the ribbon along the carrier arm outside the housing.

5. U.S. Pat. No. 3,799,315 issued to Durwood Stewart describes:

A ribbon guide or carrier arm for a typewriter ribbon cartridge is disclosed. The carrier arm which is pivotally connectable to the cartridge housing to laterally extend therefrom, has means for guiding a ribbon from the housing. An aperture is provided adjacent the end of the arm for exposing a portion of the ribbon to a type element at the print point. A retaining finger is provided adjacent the aperture to retain the ribbon for uniform smudge free typing. A cap on the end of the arm cooperates with the retaining finger in retaining the ribbon.

6. U.S. Pat. No. 3,814,231 issued to Samuel D. Cappotto describes:

A shroud is positioned near the exit area of a stuffed ribbon cartridge for a typewriter or similar machine to prevent more than one strand of a ribbon from being withdrawn from the storage chamber of the cartridge at a time. The shroud is a ridge on the floor of the storage chamber with the distance from the top of the ridge to the ceiling less than the width of the ribbon. The shroud is formed around the exit area in an arc shaped so that the single strand of ribbon being withdrawn from the storage chamber will cross the shroud substantially at right angles to the shroud from any direction that it is pulled from inside the storage chamber.

7. U.S. Pat. No. 3,830,351 issued to Samuel D. Cappotto describes:

A cartridge for housing an endless loop of ribbon for typewriters or like machines is disclosed. The cartridge includes a housing having a base plate, a storage compartment and a cover and an arm extending from the housing for guiding the ribbon from the housing to a print point and back to the housing. The arm is pivotally mounted on a fulcrum on the base plate and normally spring biased to a rest position. The fulcrum has a surface forming an oblique angle with the base plate and an upstanding member is provided on the base plate also having a surface forming an oblique angle therewith for guiding the pivotal movement of the arm. A tapered plane adjusting roller is provided between the arm adjacent an input feed mechanism to the storage compartment having a pair of split friction rollers spring biased toward each other for engaging the ribbon and stuffing it into a storage area in random convolutions. Strippers extending from the split portions of the friction rollers prevent the stuffed ribbon from winding upon the rollers. A swivel free barrel shaped roller is provided adjacent an output gate comprised of a ramp and a plurality of alternating projections defining an exit path to prevent the flow of ribbon in convolutions from the storage compartment. The arm storage compartment and cover are removably secured to the base plate by means enabling automatic assembly or hand assembly without the use of tools.

SUMMARY OF THE INVENTION

It is an object of the present invention to overcome the foregoing problems in a new, novel and heretofore unobvious manner by providing a pluggably insertable, demountable, rigid ribbon carrier transport mechanism which is engageable with drive means for moving the ribbon incrementally as the ink therefrom is used up during the printing of indicia indicating an error in the printed item on the document.

It is still further an object of the present invention to provide an inexpensive and relatively simple disposable ribbon transport mechanism which enables a relatively unskilled operator to replace the worn out or used ribbon with a fresh ribbon without the necessity of calling a serviceman or someone skilled in the operation of the machine with which the ribbon transport is to be employed.

Still a further object of the invention is to provide a ribbon transport which does not necessitate the handling of the ribbon by the operator, thus avoiding the problem of transfering ribbon ink to the person or to the clothing of the operator.

The present invention comprises an elongated, rigid ribbon transport support member provided with oppositely disposed parallel recessed grooves or channel-like areas for receiving a single-loop, endless ribbon. The ends of the support member are shaped in such fashion that the ribbon may be looped there around and thereafter secured by means of mating end caps, which are snap-fitted over the ends of the ribbon, thus avoiding any damage to the ribbon and also providing means engageable with the drive means enabling the ribbon transport mechanism to be cammed into and out of engagement with the ribbon drive mechanism. The supporting member is divided into two portions near one end thereof and provided with mating means which permits the length of the support member to be adjusted, effectively adjusting the tension on the ribbon, thus preventing any slack in the ribbon once the ribbon has been wound around the support member and inserted into operative position relative to the drive mechanism. After the length adjustment to remove the slack and provide suitable tension has been accomplished a snap-fitted fastening member is secured around the edges of the ribbon support in such fashion as to prevent the two pieces of the support from separating and also prevent any slack from appearing in the ribbon during operation of the transport mechanism. The drive mechanism for the ribbon transport comprises a pair of oppositely disposed toothed wheels, one wheel engageable with the ribbon per se while the opposite wheel acts in the nature of an idler wheel and being spring loaded toward its confronting drive wheel is effective to provide suitable tension on the ribbon transport mechanism so as to effectively drive the ribbon in one direction incrementally as the ribbon is used during printing operations. The entire assembly is made in the form of a modular unit which may be secured within a known OCR-MICR reader mechanism, of an item/sorter reader.

DESCRIPTION OF A PREFERRED EMBODIMENT

Present day sorter/reader apparatus has the capability of reading either MICR (Magnetic Ink Character Recognition) or OCR (Optical Character Recognition) type of encoding. In some instances multiple OCR-MICR reading devices are employed depending upon the level of accuracy required and the number of rejected documents which can be tolerated by the system user. All such apparatus is subject to occasional error, missorts, etc., caused by misreading a character or misinterpreting the read character. When a character, such for example, as a letter or numeral is incorrectly imprinted on the item, the apparatus can read and interpret only that information or data presented to it. However, the human operator monitoring the apparatus can visually evaluate the information and once an error is detected can initiate remedial measures to correct the misinformation. The present invention is directed to means for automatically indicating the error to the human operator so the error can be corrected by operator intervention and the machine can be caused to operate in the correct mode.

The OCR reader of the present invention interrogates the item/document "on the fly" i.e. without stopping the document in its passage relative to the reader/scanner apparatus. As the item passes in front of the scanning apparatus the reader looks at the first portion of the character or symbol and continues to look at the character as it passes thereby portion-by-portion. A constant comparison is made of each area of the document for the amount of reflectivity from the document. If the reflectivity changes the reader/scanner recognizes the change as possible character information. All of the information over the entire height and width of the character is compared. If a character is recognized this recognition data is processed through appropriate portions of the machine logic and the document is routed e.g. sorted to a specific pocket, accordingly.

Figure 1:
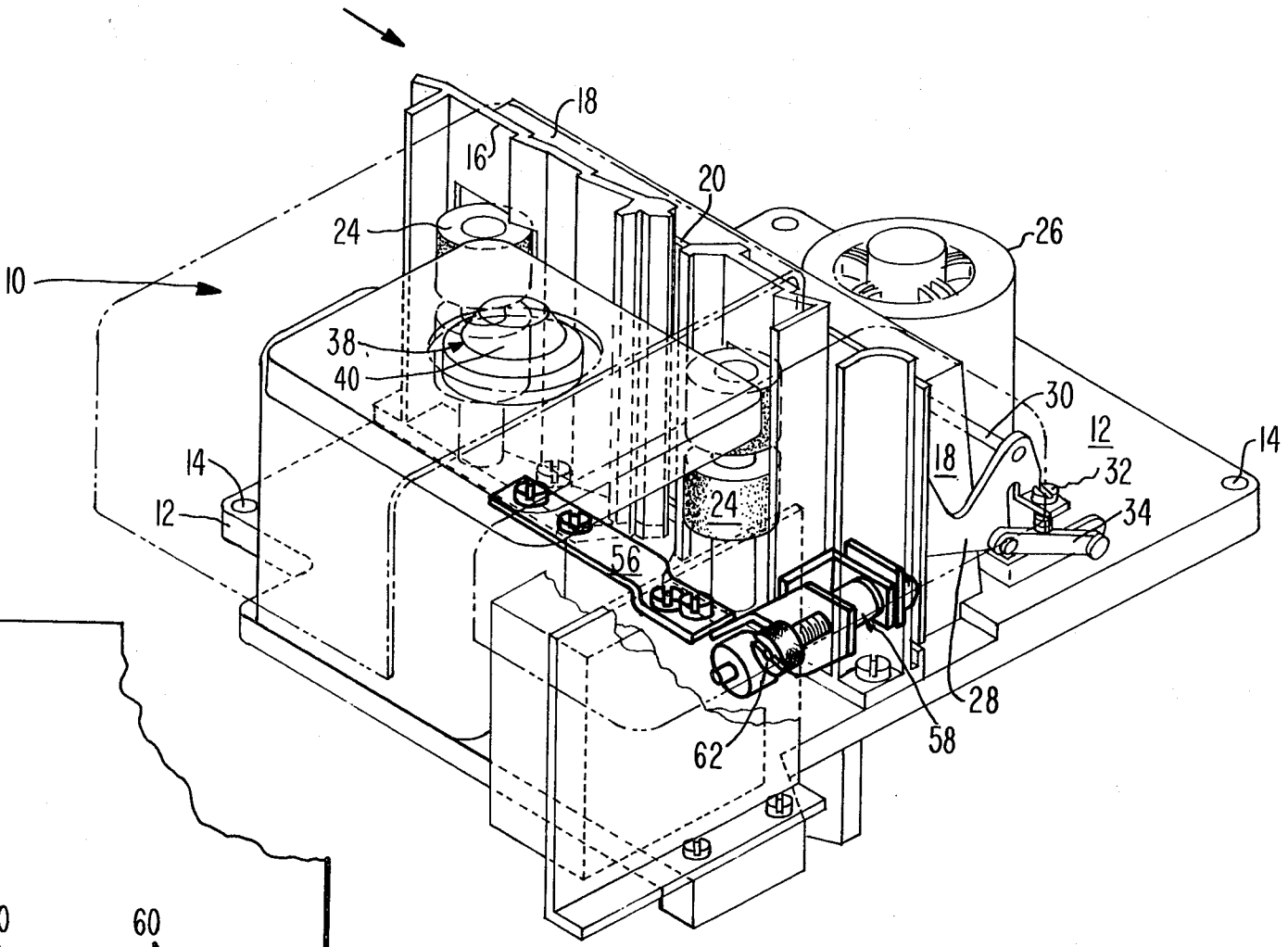
FIG. 1 is a perspective view of a modular OCR reader of the type incorporating the present invention.

If, on the other hand, the scanner "sees" a character or symbol it cannot read or a broken character, it alerts the machine logic that an unrecognizeable character has been sensed and simultaneously a timer is started which energizes and "fires" a reject marker dot printer as the unrecognizeable character passes in front of the dot printer. The distance from the center line of the OCR reader/scanner to the dot printer is an established distance and thus an electronic circuit in the logic portion of the apparatus can time a pulse as a function of this distance and effectively energize the printer accordingly. A reject mark is printed just above the character/symbol on the item/document. The "misread" item is then automatically passed to a "hold and view" station for manual correction or other appropriate action by the operator. A hold and view station of the type employed in the subject apparatus is the subject matter of a U.S. patent to Harry L. Wallace and John D. Thomas entitled "Document Hold and View Station for High Speed Item Sorter Apparatus," U.S. Pat. No. 4,155,842, issued May 22, 1979 assigned to the same assignee as the present invention. A complete reader transport modular assembly 10 is illustrated in FIG. 1. Module 10 includes a base or frame 12 provided with mounting holes 14 for locating the module 10 within a sorter/reader main frame apparatus (not shown).

Figure 7:
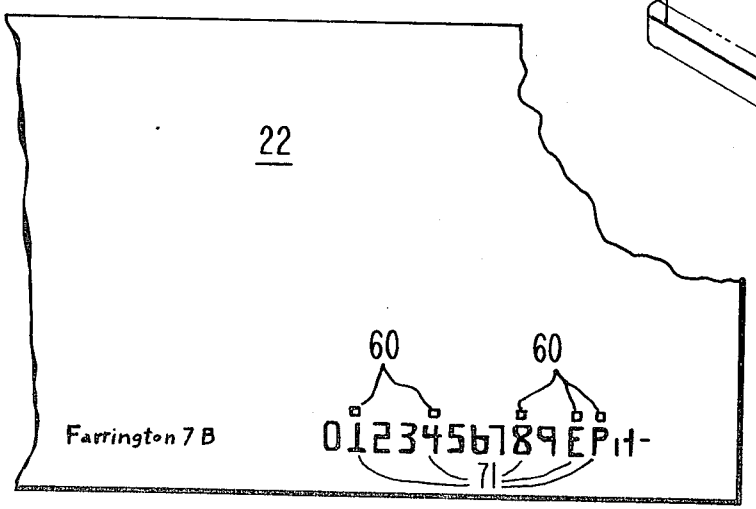
FIG. 7, is a plan view or a portion of a check/item illustrating the error correction indication relative to the OCR encoding on the item.

Irregularly shaped front wall member 16 in cooperation with planar rear wall member 18 forms a track or channel 20 within which item/documents such as checks 22, FIG. 7 and the like, can be transported at relatively high speed by means of two pairs of parallel concentric rollers 24—24 (FIG. 1) driven by drive motor 26, the latter being secured to base 12. For ease of access to the items 22 (FIG. 7), should it become necessary or required to relieve a jam or pile up of items 22 within channel 20 (FIG. 1), rear wall member 18 is horizontally moveable arcuately, rearwardly FIGS. 1, 2 and 3 from a closed track forming position to an open access position by means of oppositely disposed hinges 28 (FIG. 1) and the elongated horizontal coupling-handling rod 30 secured to the opposite ends of wall member 18 (only the right hand hinge 28 being shown in FIG. 1). Adjusting bolt 32 and link 34 from an over-center type transport lock bracket which permits the channel 20 to be opened or accessed at will. Compression idler rollers 35 (FIG. 2) carried by the fold-back rear wall member 18 cooperate with drive rollers 24—24 to move the itmes 22 (FIG. 7) through the transport channel 20 (FIG. 1).

Figure 2:
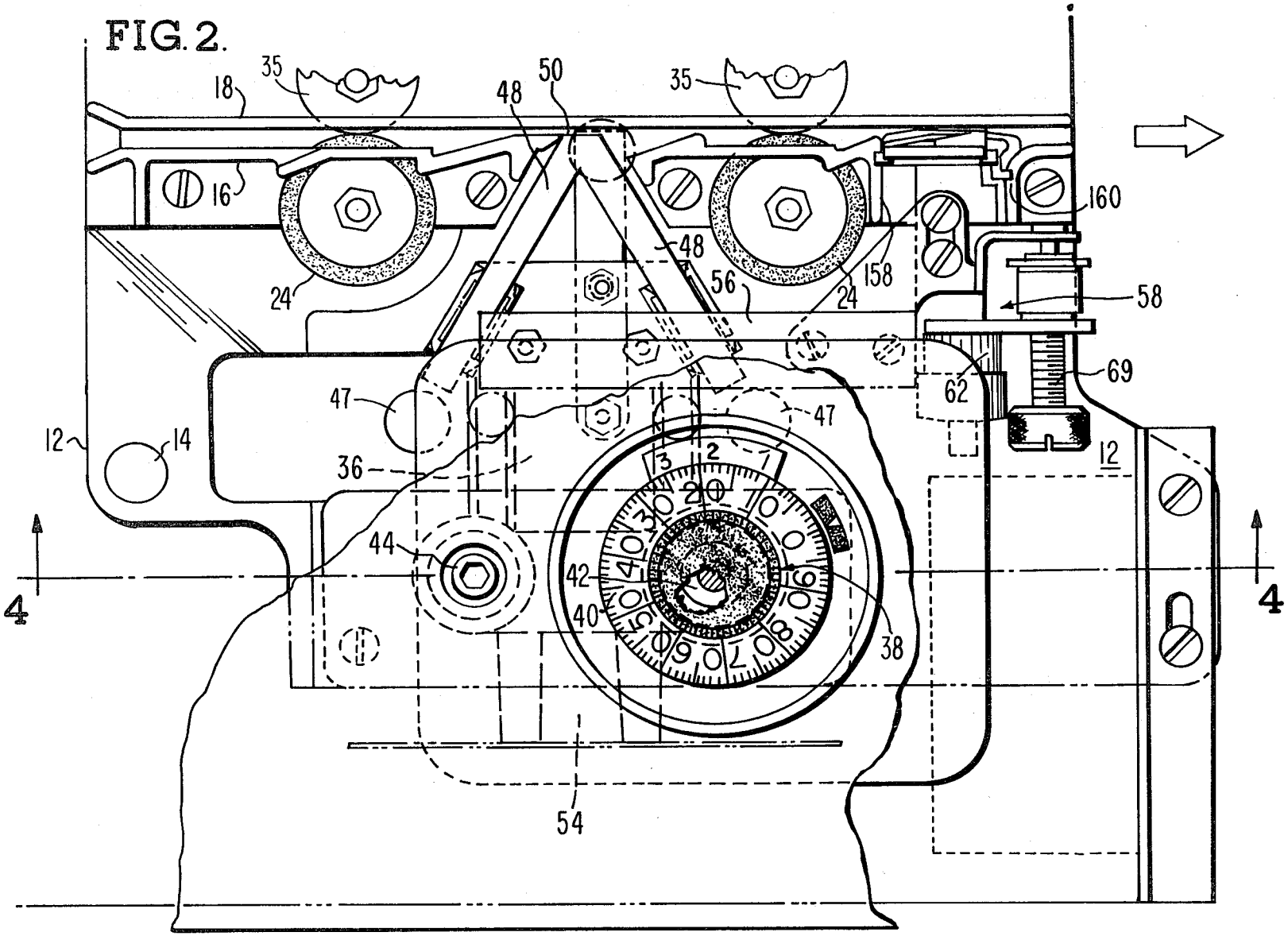
FIG. 2, is a top plan view of the assembly of FIG. 1.
Figure 3:
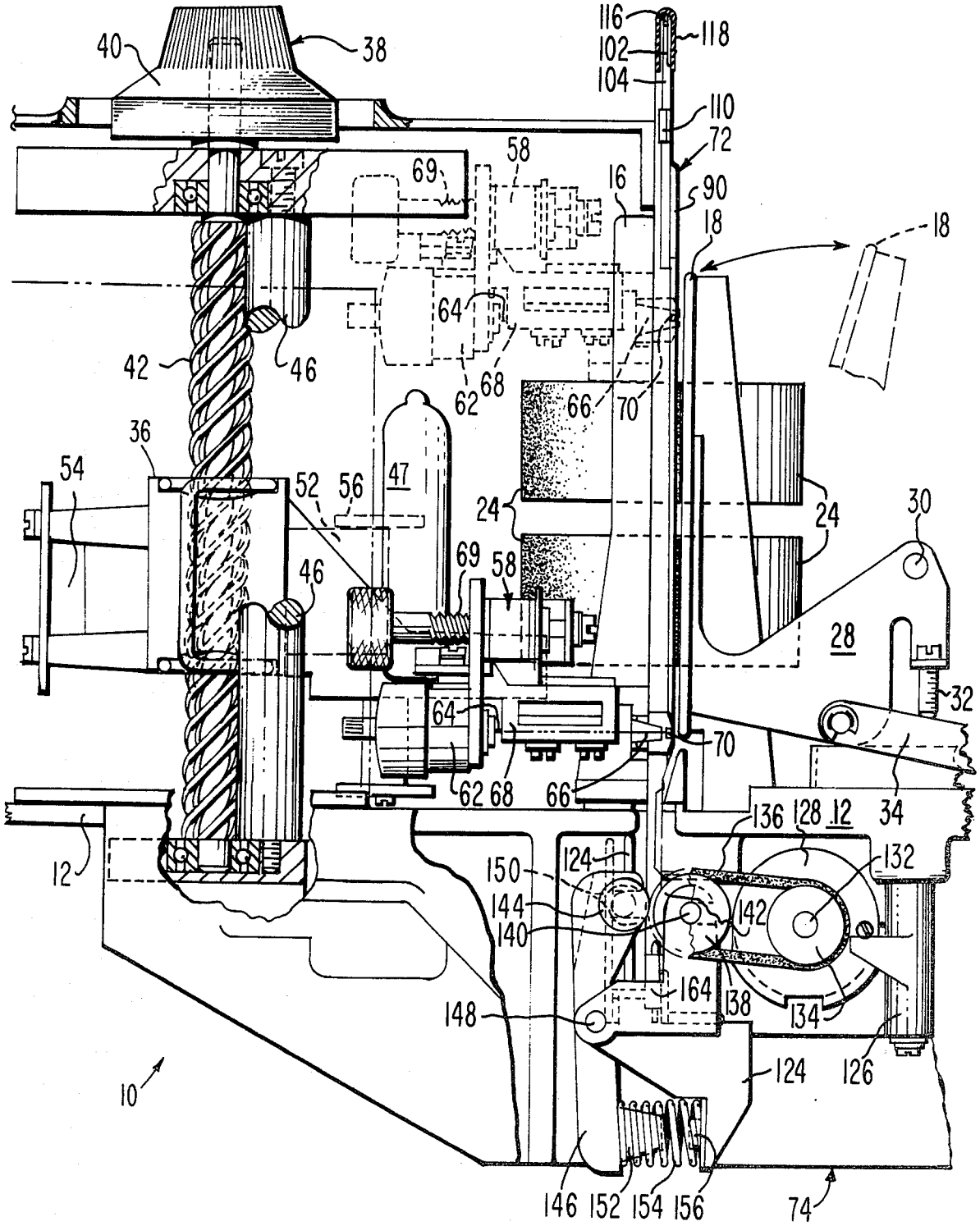
FIG. 3, is a side elevational view of the assembly of FIG. 1.
Figure 4:
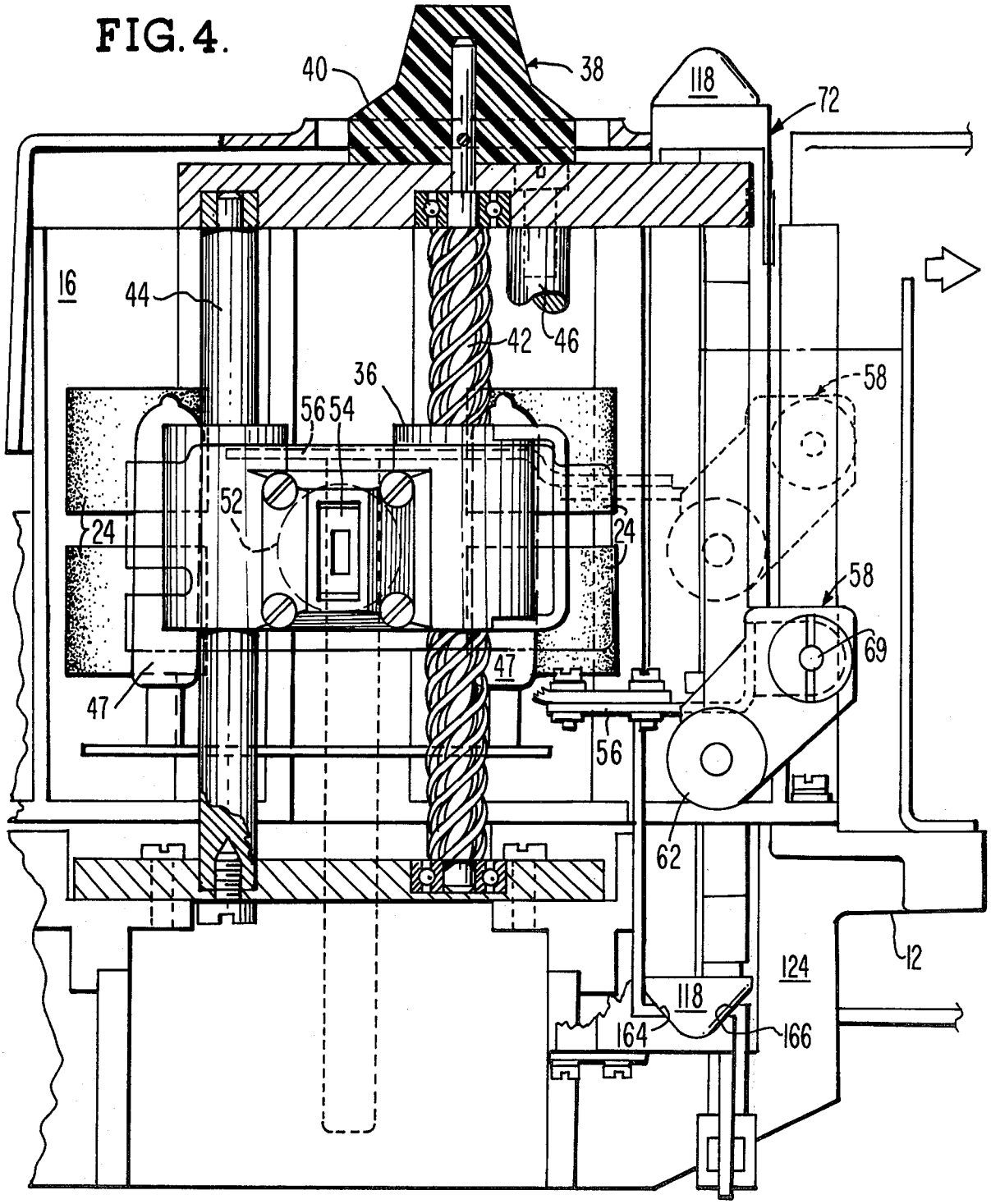
FIG. 4, is a rear elevational view along the line 4—4 of FIG. 2 of the apparatus of FIG. 1.

A solid state image sensing device 36, FIGS. 2 and 3 disposed centrally of module 10 (FIG. 1) is carried by a scan height elevating-adjusting mechanism 38 (FIG. 2) disclosed in an application filed Feb. 5, 1979 in the names of Frederick G. Krebs and Daniel B. Abbott entitled "Backlash Free Adjusting Mechanism," Ser. No. 009,347, assigned to the same assignee as the present invention. A scan height adjust knob 40, FIGS. 1 and 2 in conjunction with a helically threaded screw 42, FIG. 3 and parallel guide rod 44, FIG. 4 are operably adjusted by means of the scan height adjust knob 40 to move image sensing device 36 vertically up or down a vertical distance approximately 3.2 inches for purposes to be described later on herein. A second parallel rod 46, FIGS. 3 and 4 offset but parallel to rod 44 acts as a support to maintain the elevating structure level.

Sensing device 36 includes a pair of oppositely disposed Halogen lamps 47 only one of which is shown in FIGS. 3 and 4 and a rectangularly-shaped light guide 48, FIG. 2 for directing light from the lamps 47 onto the document scanning area 50. An adjustable lens 52, FIG. 3 focuses reflected light onto an image sensor 54. Image sensor 54, a solid state device specifically, a charge coupled device, receives the reflected light back from the item/document 22 (FIG. 1) as the latter is moved therepast by rollers 24—24.

Carried by the elevating mechanism 38 is a horizontally extending irregularly shaped flat bracket 56 (FIGS. 2, 3 and 4), the free end of which supports reject marker apparatus 58, (FIG. 3) which is adapted to place an identifying mark or dot 60 FIG. 7 over the character or characters which are erroneously encoded on the documents or items 22 as will be described more particularly herein later on. As seen in FIG. 3, reject marker apparatus 58 which is a demountable modular assembly comprises a solenoid 62 through the cylindrical hollow center of which a drive wire 64 projects and is moveable upon energization of the solenoid 62 over interconnecting electrical conductors (not shown) as will be described later on herein. The forward end of drive wire 64 is freely supported for longitudinal movement in a channel bracket 66 secured to bracket 56 by bolts. The terminal end of wire 64 which extends within guide 68 is provided with an imprinting member 70 which is adapted, upon energization of solenoid 62, to imprint the rectangular, solid mark 60 upon document 22. Mark 60 (FIG. 7) indicates to the operator that the character 71 over which the mark 60 is imprinted is in error.

To avoid any possibility of lack of printing or too light printing as a result of the distance between the moveable rear wall member 18 (FIG. 3) changing slightly relative to the print guide 68 due to item document thickness variations etc., a differential screw adjustment member 69 is provided. Rotation of the screw adjustment member 69 causes the imprinting member 70 to move toward or away from the rear wall member 18.

As can be seen from FIGS. 1–4, the space within the module 10 is relatively cramped; so much so that locating a conventional inking roller, ribbon or other similar conventional device to ink the dot printer reject marker apparatus 58 is practically impossible. In addition, servicing such a piece of apparatus would be overly costly and time consuming not to say extremely inefficient and difficult for the operator.

Figure 5:
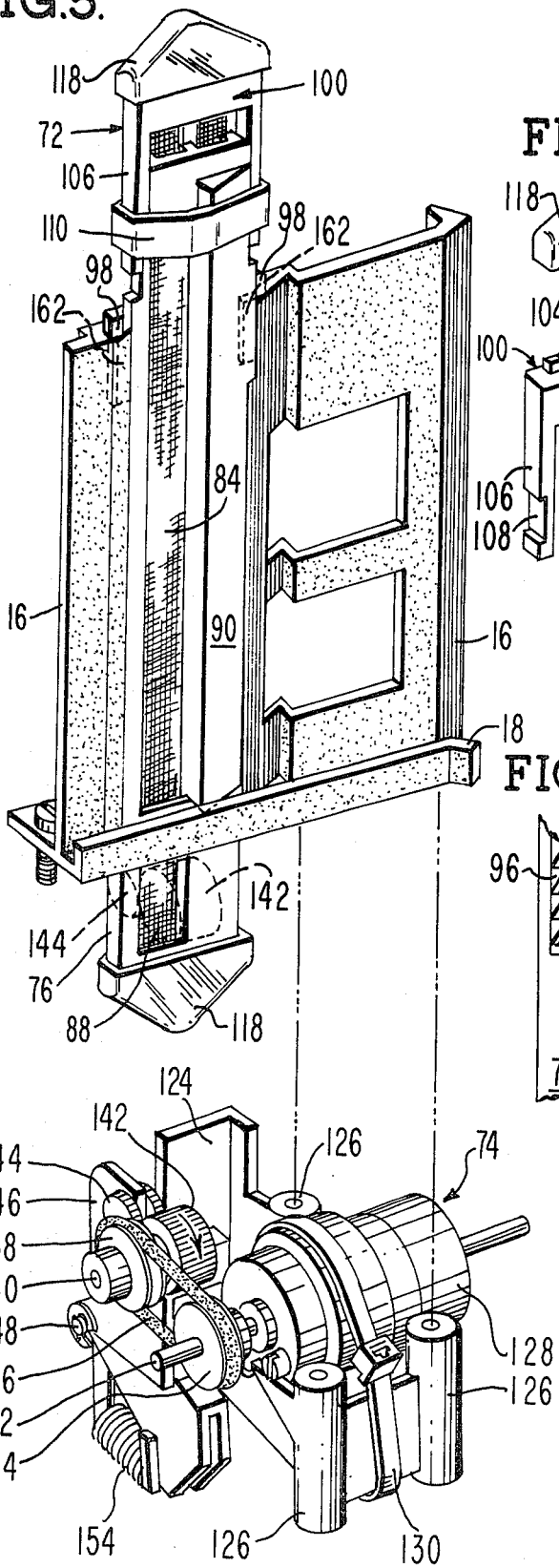
FIG. 5, is a perspective view of the demountable ribbon cartridge illustrated in conjunction with the drive mechanism for moving the ribbon.

The present invention solves these and other associated problems in a new, novel and heretofore unobvious manner by providing a demountable, replaceable, disposable (throw-away) inked ribbon cartridge carrier transport assembly 72 (FIG. 3) for the module 10 (FIG. 1). Assembly 72 FIGS. 4, 5 and 6 is arranged for demountable, driving engagement with a novel drive mechanism 74, FIG. 5 each of which will be described in detail.

Inked Ribbon Cartridge Carrier-Transport

As seen in FIGS. 3, 4, 5 and 6A–6D, ribbon cartridge carrier transport assembly 72 comprises an elongated, rigid, member 76 (FIG. 6A) formed of relatively inexpensive, light weight material e.g. plastic, as by molding. Member 76 is provided with two separated but parallel, elongated channels or grooves 78—78 extending from end-to-end thereof. One end of member 76 (lower end in FIG. 6A) is angularly A-shaped terminating in an apex portion 80 the slanted sides 82 thereof providing a turn-around for an endless, seamless ribbon 84. An elongated access opening or aperture 86 extends for a considerable distance along one side of member 76 coextensive with one of the grooves 78. A narrower, smaller rectangular opening or aperture 88 is located along the same groove 78 as opening 86 terminating just short of the lower apex portion 80, FIG. 6A for purposes to be described shortly herein. Paralleling the long opening or aperture 86 but on the opposite side edge of member 76 is a raised, elongated wedge shaped member 90, FIG. 6A the purpose of which will also become clear as the description proceeds.

The upper end of member 76 is terminated at right angles or normal to the longer dimension thereof as at 92. The opposite side edge portions of member 76 adjacent to the end 92 are each provided with an elongated, shallow, channel or groove 94 terminating in a plurality of raised notches or angularly oriented teeth 96 extending a fixed distance from end 92 and of the same width as grooves 94. Retaining tangs 98 extend outwardly away from the opposite edges of member 76 for purposes to be explained presently.

A squared off inverted U-shaped member 100 (FIG. 6A) is employed with member 76 to provide ribbon tension adjustment and to secure such adjustment once made, as will now be described. The upper end portion of member 100 is provided with an A-shaped apex 102 having opposite slanted sides 104 effective to enable the seamless ribbon 84 to turn around thereover without binding. The opposite depending extremities or legs 106 of member 100 are each notched as at 108 so as to retain spring clip 110 when members 76 and 100 are effectively, adjustably joined as desired later on herein. The inner edge of each leg 106 is provided with a narrow raised projection or land 111 and a row of teeth 112 adapted for sliding reception within grooves 94 and for mating engagement with teeth 96 in the manner and orientation illustrated in the enlarged detail view of FIG. 6C.

The lower end of member 76 and the upper end of member 100 are each formed with an integral pedestal-like projection 114 and 116 as the apex of the respective member 76, 100. These projections 114, 116 keep the two opposite runs of ribbon 84 separate and apart and also act to prevent the ribbon 84 from sliding off the turn around ends formed by apex portions 80 and 102. Parallel channels or grooves 117—117 mate with grooves 78—78 when the two members 76 and 100 are assembled together.

Figure 6B:
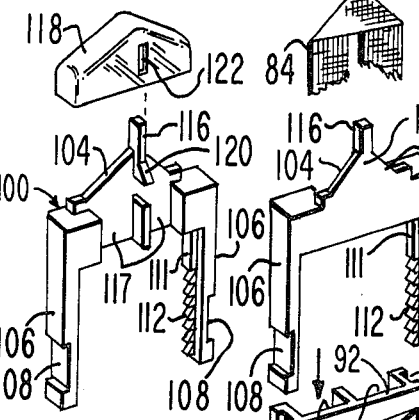
FIG. 6B, is an isometric view of the adjustable portion of the device of FIG. 6A (The view being reversed relative to FIG. 6A) illustrating the snap apart end around protector.
Figure 6A:
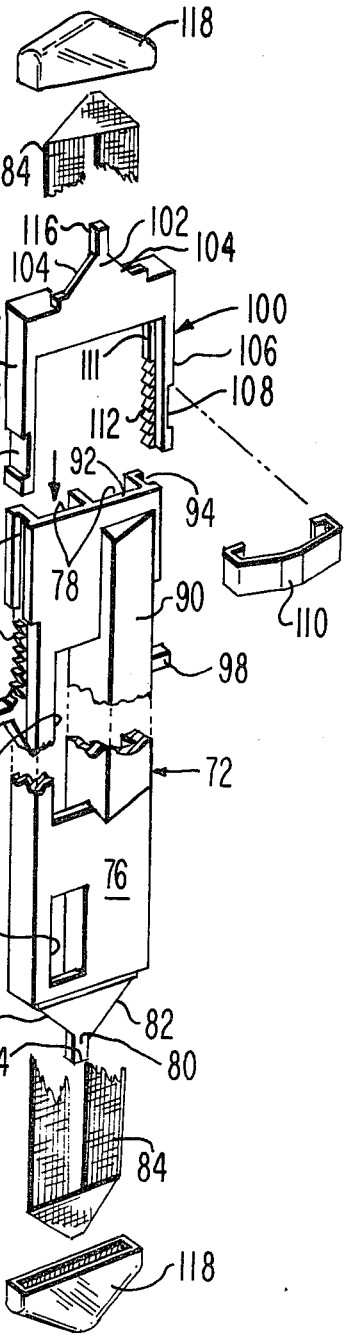
FIG. 6A, is an exploded isometric view of the ribbon cartridge of the present invention illustrating its assembly and tension adjusting feature thereof.
Figure 6C:
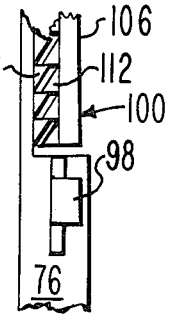
FIG. 6C, is a detail view of the notched or toothed section of the adjustable portion of the ribbon cartridge.
Figure 6D:
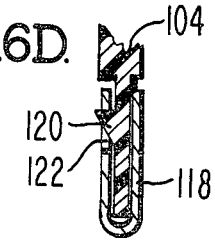
FIG. 6D, is a sectional detail view of the ribbon end around protector of the ribbon cartridge.

An end cap 118 for each end of the assembled ribbon cartridge carrier transport assembly 72 is provided and is adapted to be snap fitted over each end so that the wedge shaped projection 120 (at each end, only the upper end being illustrated in FIG. 6B) snaps into the aperture 122 in each end cap 118 to retain the cap 118 in position, as seen most clearly in the detail view of this construction in FIG. 6D. End caps 118 act in the nature of ribbon end guards for the ribbon turn around formed by apex portions 80 and 102 (FIG. 6A) at each opposite end of the composite ribbon cartridge carrier transport assembly 72 as well as a means for permitting the transport assembly 72 to be operably engaged by the drive mechanism 74 (FIG. 5) as will now be described.

Ribbon Cartridge Transport Drive Mechanism

Because the ribbon cartridge carrier transport assembly 72 (FIGS. 3 and 4) is adapted to be demountably insertable within the reader module 10 with respect to the reject marker apparatus 58, it is required that the drive mechanism 74 (FIG. 5) accommodate to this feature. Thus a conventional drive train is not adaptable to operate in the manner required for this purpose.

Ribbon cartridge transport drive mechanism 74 is seen by reference to FIGS. 3 and 5 to include a shallow box-like frame or support member 124 having a plurality of pedestal-like attachment members 126 for securing frame 124 to the lower surface of base 12 of module 10 as seen most clearly in FIG. 3. An electrical drive motor 128 energized over leads (not shown) is demountably secured by means of a circular strap 130 (FIG. 5) within a shallow recess provided by frame 124. Output shaft 132 of motor 128 carries a pulley 134 around which a flexible drive belt 136 extends for driving engagement with pulley 138 on shaft 140.

The inboard end of shaft 140 carries a ribbed or fine-toothed ribbon drive gear wheel 142 which is disposed in confronting contact with a double-sided notched idler gear wheel 144. An irregularly shaped rockable member 146 pivoted at 148 FIG. 3 to frame 124 loosely carries and rotatably supports wheel 144 at one end thereof by means of a U-shaped notch 150 therein (FIG. 3). The opposite end of member 146 is provided with an integral spring mounting pedestal 152 securing one end of a biasing compression spring 154. The opposite end of spring 154 surrounds and seats upon a small projection 156 on the lower portion of frame 124. Spring tension provided by spring 54 is sufficient to maintain the double sided wheel 144 in mesh and driving engagement with the wider ribbon advance wheel 142.

Ribbon cartridge carrier transport assembly 72 is adapted to be slideably, demountably, receivable between the confronting vertical edges 158 and 160, FIG. 2 of front wall member 16 so that the oppositely disposed retaining tangs 98, FIG. 6A on assembly 72 are disposed in and bottom within the respective shallow channel-grooves 162, FIG. 5 in the upper portion of wall member 16. The insertion movement of ribbon cartridge carrier transport assembly 72 causes the end cap 118 to rock member 146 arcuately backwardly moving double wheel 144 away from enlarged drive gear wheel 142 so as to engage the drive gear wheel 142 with the ribbon 84 through the opening 88, FIGS. 5 and 6A.

As seen in FIGS. 3 and 4, continued insertion movement of the ribbon cartridge carrier transport assembly 72 causes the structure to bottom within the hollow rear portion of the motor support member 124 with the angularly, upwardly canted edges of the cap 118 seated against the oppositely disposed chamfered edges 164 and 166, FIG. 4 of the motor support member 124. With the ribbon cartridge carrier transport assembly 72 thus in place and with the reader sorter placed in operation the reject marker apparatus 58 is ready to print the rectangular error indicating dot 60 (FIG. 7) over the incorrect character 71 should one appear on the document i.e., check item 22.

Operational Description

The reader/sorter is placed in operation so that the sensing device 36 (FIG. 2) is operating in accordance with the prescribed requirements for the system. A series or bundle of document items 22 (FIG. 7) is placed in the input hopper (not shown). The apparatus is now considered ready for sorting documents 22. The sorter drive is energized to cause the document items 22 to pass at high speed before the sensing device 36 (FIG. 2). The reader/scanner interrogates the optical characters 71 (FIG. 7) on the face of each item 22 to determine whether or not such optical character 71 can be recognized by comparison with those indicia which are stored in the main memory of the reader/sorter apparatus. This operation will continue until such time as the sensing device 36 (FIG. 2) determines that an incorrect character 71 (FIG. 7) has been placed on the check item 22 or until such time as the character 71 being sensed is either incomplete or nonreadable. At this point, the reject marker apparatus 58 (FIG. 3) is automatically energized by the sensing device 36 in conjunction with a reader memory output to place a dot indicia 60 (FIG. 7) over the incorrect character 71 after which the document item 22 is passed to hold and view station so that an operator can take over visually. The operator determines from the indicia on the face of the document 22 including the courtesy amount, the correct information and such correct information is inserted on the item 22 which can then be placed in the sorter/reader to be once again read and sorted to the correct pocket.

The drive motor 128 (FIG. 5) for the ribbon cartridge carrier transport assembly 72 of the reject marker apparatus 58 (FIG. 3) operates at high speed, intermittenly and to the extent that it is required to index, will do so automatically. The optical characters 71 (FIG. 7) used most frequently in this connection are those employed with credit card type "documents." This information can be found on credit card bills where the OCR information-characters are imprinted by hand or by means of a semiautomatic printer. As the reject marker apparatus 58 (FIG. 3) is set up for use, it is capable of indicating 16 rejected characters 71 (FIG. 7) per document 22. That is to say, there can be four rejected characters per field with four fields per document or a total of 16 rejected characters per individual item 22 (FIG. 7). Thus, it is a fairly low usage type of device and actually prints over less than one percent of the total information which passes in front of it.

The distance between the moveable platen wall member 18 which serves as a document guide and the imprinting member 70 can be fairly critical due to the fact that the reject marker apparatus 58 is a low energy device and small variations in this distance can cause large variations in print density. To offset this criticality the head to platen adjustment is made by means of adjusting the differential screw adjustment member 69. This movement permits the reject marker apparatus 58 to move so as to bring the wire 64 which causes the dot to be printed reasonably close to the document 22 (FIG. 7) so that the actual excursion that the wire 64 (FIG. 3) has to make is relatively short. Ribbon changing of the endless loop ribbon 64 (FIG. 6A) is simple and efficient due to the novel ribbon cartridge carrier transport assembly 72. The operator need not handle the ribbon 84 per se but introduces the ribbon 84 and ribbon cartridge carrier transport assembly 72 as a unitary assembly into the slotted aperture in front wall member 16 (FIG. 1) so as to engage the ribbon 84 with the drive mechanism 74. The operator never touches the ribbon 84 nor does the ribbon 84 ever contact the operator or the operator's clothing.

Since the individual paper check items 22 (FIG. 7) are relatively flimsy, wedge shaped member 90 (FIG. 6A) integral with the ribbon cartridge carrier transport assembly 72, enables the document 22 to pass on edge across the wedge shaped member 90 without hanging up on the ribbon 84 or the rather long opening 86 through which the ribbon 84 must pass in its vertical excursion. This opening 86 is of considerable length, approximately 3.2 inches, to accommodate the positioning of the wire guide 68 (FIG. 3) and imprinting member 70 from its lowest to its highest operating position. The relatively irregular shape of the face of the inner wall member 16 (FIG. 1) adjacent the optical sensing device 36 (FIG. 3) provides a relatively narrow corridor or channel 20 (FIG. 1) through which each item 22 (FIG. 7) must pass. This prevents the data on the document 22 from becoming out of focus due to the flimsy nature of the item 22. The areas of wall member 16 adjacent to the access openings for the drive rollers 24—24 as well as the opening for the light sources 47 (FIG. 3) are slanted or shaped so as to cause the item 22 (FIG. 7) to move away from the opening slightly thus preventing the item 22 from getting snagged or hung up in its passage through the scanning area 50, FIG. 2. The ribbon cartridge carrier transport assembly 72 has been structured such that depending upon the cost of materials and frequency of use, among other considerations, the device can be manufactured as a throw-away unit in which case as the ribbon 84 (FIG. 6A) is "used up" and no longer produces readable printing it can be easily replaced with a fresh ribbon 84 in a new plastic ribbon cartridge carrier transport assembly 72.

The ribbon 84 is a one piece, seamless member, which is initially stretched around the two opposite ends of the ribbon cartridge carrier transport assembly 72 with the two parallel "runs" of ribbon 84 located within the two channels 78—78 and 117—117 (FIG. 6B). The end caps 118 provide clearance and free space for the ribbon 84 (FIG. 6A) to move around the slanted edges 82 and 104 of the opposite ends of the ribbon cartridge carrier transport assembly 72 while also serving to protect the ribbon 84 against damage during insertion and removal from the base machine. In addition, the end cap 118 serves as a limit means when the ribbon cartridge carrier transport assembly 72 is inserted into the drive frame 124, FIG. 5.

The wedge shaped projection 120 (FIG. 6B) holds the end cap 118 in place preventing accidental dislodgement thereof during insertion, use and/or removal. The end cap 118 is removable by simply squeezing the edges and lifting or pulling the end cap 118 away from the main ribbon cartridge carrier transport assembly 72.

The raised projections 111 and teeth 112 are the same height and width so as to make a sliding fit with the grooves 94 and teeth 96 of the member 76. This arrangement tends to avoid any tendency for the completed ribbon cartridge carrier transport assembly 72 to wobble or skew when the ribbon 84 is stretched taut.

As noted hereinbefore, the teeth 96 and teeth 112 are shaped in directions such that when the two members 76 and 100 are interlocked, movement is permitted only in one direction i.e., separating the two members. Thus, to place the ribbon 84 under required and suitable tension the two members 76 and 100 are moved apart slightly by hand during which time the teeth 96 and 112 simply snap over one another. When final tension is attained the spring clip 110 is snapped into notch 108 and the assembled ribbon cartridge carrier transport assembly 72 is ready for use. Slight inward pressure at the back of the spring clip 110 enables the operator to remove the clip 110 quite readily should this be necessary.

With the ribbon 84 under proper tension it is a simple matter for the operator to insert the cartridge carrier transport assembly 72 cap end down, vertically into the channel developed between the edges of the front wall member 16 (FIGS. 1 and 4). The lower cap 118 seats with its slanted edges resting upon the slanted edges 164–166, FIG. 4 of the ribbon drive mechanism 74.

The reject marker apparatus 58 (FIG. 3) is adjusted to the desired height depending upon the particular document style being read and sorted and the apparatus is ready for operation.

We claim:

1. A demountable, disposable ribbon cartridge for use with a dot printer for printing on check item documents comprising:

a flat, thin, elongated, rigid member having integral means for deflecting the documents relative thereto, the rigid member including means for guiding a single loop of inked ribbon from end to end thereof;

means, operably associated with the ribbon guiding means, for adjusting the length of the ribbon cartridge effectively placing the ribbon loop under suitable tension for printing therefrom, wherein the ribbon cartridge length adjusting means includes a u-shaped member having a plurality of serrations along a substantial portion of each parallel leg of the u-shaped member and wherein the rigid member is provided with a similar plurality of serrations along the external edges thereof for mating engagement with the serrations of the u-shaped member effective to provide an adjusting mechanism; and means, integral with the rigid member, for operably positioning the cartridge relative to an associated drive means and to a printing mechanism with which the cartridge is employed.

2. The invention of claim 1, wherein the means for operably positioning the cartridge relative to an associated drive means and to a printing mechanism comprises oppositely disposed projecting means for restricting the insertion depth of the cartridge within the printing mechanism with which the cartridge is operably employed.

3. A dot printer ribbon cartridge transport apparatus comprising:

a separable, elongated, rigid, light-weight, ribbon supporting cartridge member having means for captivating an endless loop of inked ribbon, the ribbon supporting cartridge member including a longer body portion and a shorter body portion, a pair of parallel grooves bordering a medial land extending from end to end of the longer body portion, a first elongated aperture approximately coextensive with one of the grooves and a second aperture adjacent to the first aperture and providing access for a ribbon drive member, adjusting means disposed along the edges of one end of the longer body portion, the shorter body portion forming a demountable adjustably positionable member forming an end support and turn around for the ribbon, complimentary adjusting means on the shorter body portion matingly engageable with the adjusting means on the longer body portion to vary the length of the ribbon supporting cartridge member, and means for retaining the two body portions in adjustment and mated engagement to keep the ribbon taut during use; and drive means, including means operably engageable with the ribbon supporting cartridge member, for demountably engaging the cartridge member with the drive means and for advancing the ribbon.

* * * * *

UNITED STATES PATENT AND TRADEMARK OFFICE

CERTIFICATE OF CORRECTION

PATENT NO. : 4,243,330

DATED : January 6, 1981

INVENTOR(S) : Harry L. Wallace, etal

It is certified that error appears in the above—identified patent and that said Letters Patent is hereby corrected as shown below:

Column 8, Line 38, should read "tension provided by spring 154".

Column 9, Line 18, should read "on the item".

Column 9, Line 63, should read "loop ribbon 84".

Signed and Sealed this

Fourteenth Day of April 1981

[SEAL]

*Attest:*

RENE D. TEGTMEYER

*Attesting Officer*

*Acting Commissioner of Patents and Trademarks*